US006171017B1

(12) United States Patent
Watkins

(10) Patent No.: US 6,171,017 B1
(45) Date of Patent: Jan. 9, 2001

(54) ROADWAY CRACK REPAIR APPARATUS AND METHOD

(76) Inventor: Paul A. Watkins, 1068 Jacaranda Rd., Colton, CA (US) 92324

( * ) Notice: Under 35 U.S.C. 154(b), the term of this patent shall be extended for 0 days.

(21) Appl. No.: 09/356,792

(22) Filed: Jul. 20, 1999

(51) Int. Cl.[7] ..... E01C 19/18
(52) U.S. Cl. ..... 404/84.05; 404/72; 404/75
(58) Field of Search ..... 404/72, 74, 75, 404/82, 84.05, 84.1, 92, 101, 104, 108, 102, 110, 111

(56) References Cited

U.S. PATENT DOCUMENTS

| | | | | |
|---|---|---|---|---|
| 4,407,605 | | 10/1983 | Wirtgen . | |
| 4,954,010 | | 9/1990 | Montgomery et al. . | |
| 5,215,071 | | 6/1993 | Mertes et al. . | |
| 5,364,205 | * | 11/1994 | Lemelson | 404/72 |
| 5,485,084 | | 1/1996 | Duncan et al. . | |
| 5,553,969 | * | 9/1996 | Reed | 404/110 |
| 5,626,261 | | 5/1997 | Wanstrath . | |
| 5,746,539 | * | 5/1998 | Mara | 404/84.05 |

* cited by examiner

*Primary Examiner*—Robert E. Pezzuto

(74) *Attorney, Agent, or Firm*—Sheldon & Mak

(57) ABSTRACT

A roadway crack repair system includes a crack cleaning module and a crack sealing module. Each module includes a steerable vehicle for navigating the roadway, a platform being laterally movable on the vehicle in response to a control signal, a sensor being mounted on the platform for detecting local variations in the roadway during movement of the vehicle, a sensed continuous local deviation indicating a roadway crack. A controller is responsive to the sensor for generating the control signal as a sensed lateral position of the crack relative to the sensor, causing the sensor to accurately follow the crack when the vehicle is generally driven along the crack. A router is mounted on the platform behind the sensor of the crack cleaning module for cleaning and widening the crack, and a vacuum system removes loose material from the roadway behind the router. A front-mounted scarifier dislodges foreign material that might otherwise interfere with operation of the sensor, another vacuum inlet being located between the scarifier and the sensor. A sealer outlet is mounted on the platform behind the sensor of the crack sealing module for feeding a sealant medium into the crack. A pressure roller behind the sealer outlet compacts and levels the sealant medium and the roadway, sand being dispensed ahead of the roller for preventing adhesion of sealant on the roller, loose sand being removed by vacuum behind the roller. Also disclosed is a method for repairing roadway cracks.

22 Claims, 3 Drawing Sheets

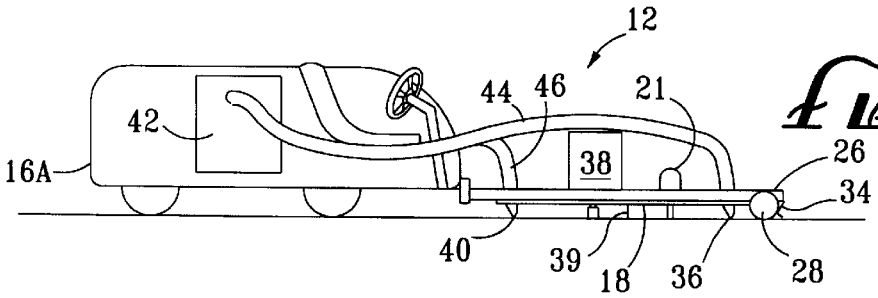
FIG. 2
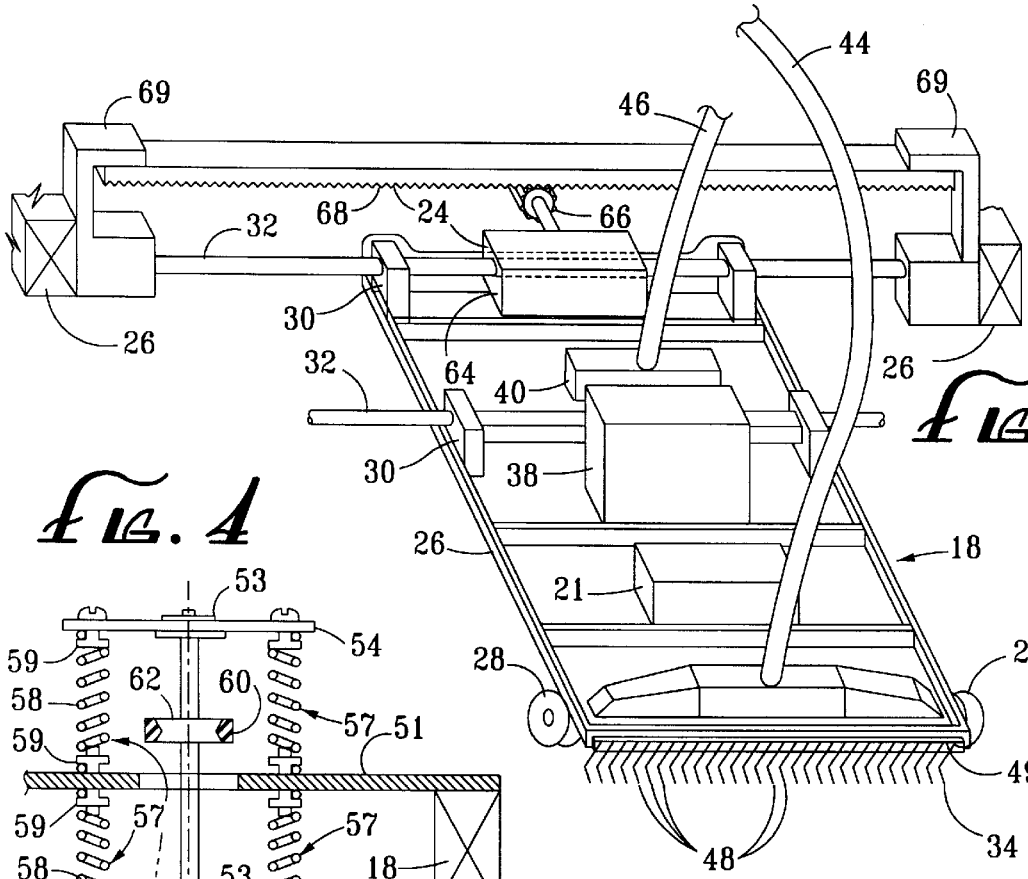
FIG. 3
FIG. 4
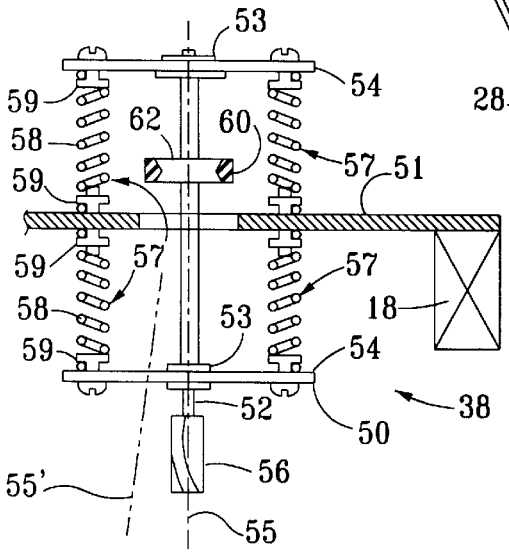
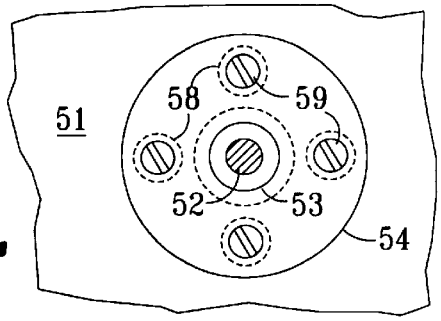
FIG. 5

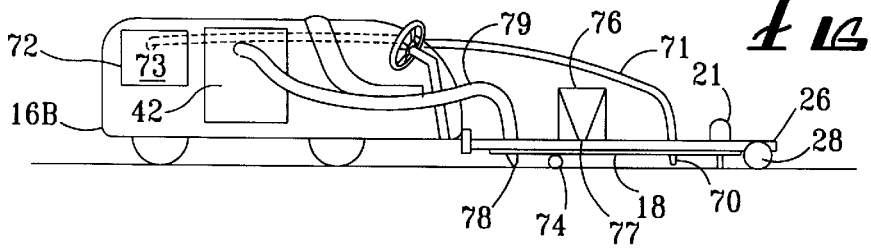
FIG. 6
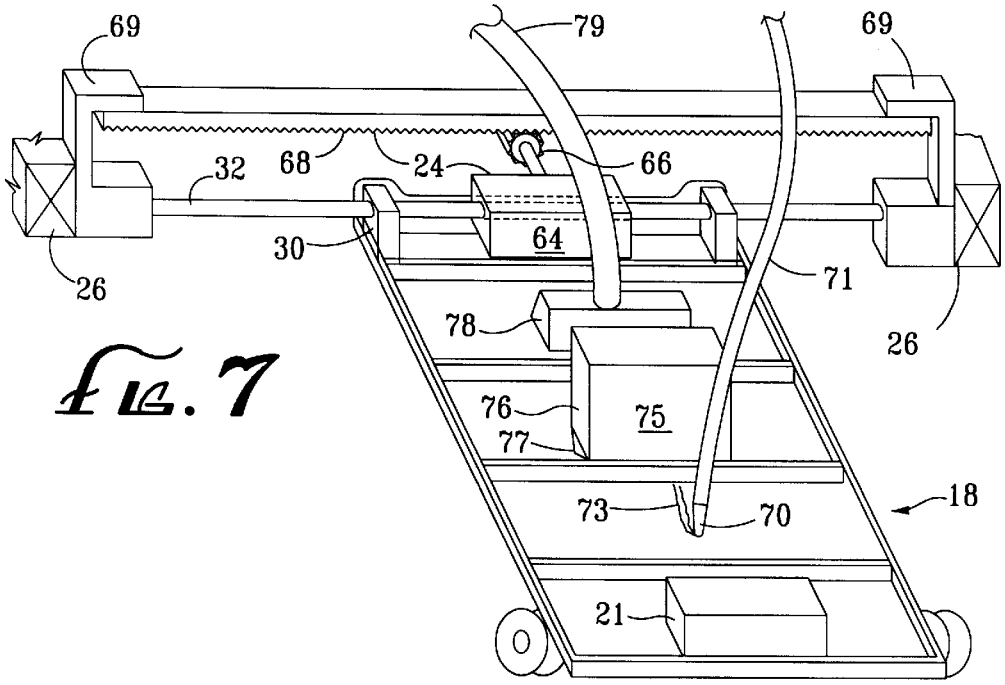
FIG. 7
FIG. 8A
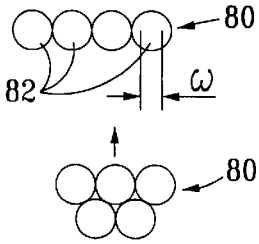
FIG. 8B
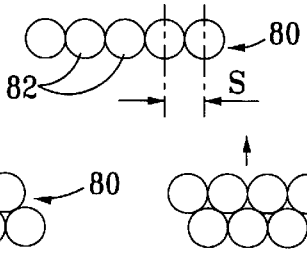
FIG. 8C
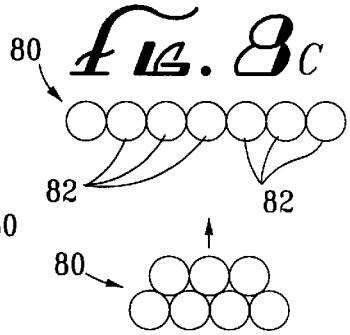
FIG. 8D
FIG. 8E
FIG. 8F
FIG. 8G

ROADWAY CRACK REPAIR APPARATUS AND METHOD

BACKGROUND

The present invention relates to roadway maintenance and crack repair, and more particularly to systems for cleaning and filling such cracks that typically develop over time in roadways having coatings of concrete or asphalt including bitumen and aggregate and the like.

In roadway maintenance, crack repair traditionally involves manually cleaning the cracks by removing material therefrom, and filling with a material that may contain aggregate. In some cases, a stream of the thermoplastic material is manually directed onto the roadway generally into the crack, with some of the thermoplastic material (such as tar) remaining on the roadway surface on opposite sides of the crack. In other cases, a crack sealant is used to fill cracks that are first enlarged by sawing or routing during the cleaning. U.S. Pat. No. 5,215,071 to Mertes et al. discloses a riding pavement saw having a hydraulically powered blade that rotates on a generally horizontal axis, the blade being supported approximately midway between a pair of front wheels, the machine being steered by a single rear wheel that is operator-controlled.

U.S. Pat. No. 4,407,605 to Wirtgen discloses a powered vehicle having a pavement heater and milling device, modified to provide a rotating chisel cutter for removing a relatively wide portion of the pavement to an adjustable depth in the repair of longitudinal cracks. The milling device is mounted for laterally adjustable positioning relative to the vehicle, whereby initial positioning of the vehicle can be simply parallel to the crack, the vehicle being further maneuvered to follow the crack after the lateral positioning of the milling device is completed. The cutter rotates on a transverse horizontal axis, with chisel elements being spaced along the axis and located within a container that is fed with aggregates and/or liquid to be mixed with pavement that is removed by the milling device, the augmented aggregate mix being reapplied from the container onto the roadway.

U.S. Pat. No. 4,954,010 to Montgomery et al. discloses a maintenance truck equipped with a transverse-mounted slurry sealant box assembly for filling transverse roadway cracks and blending stepped pavement segments These and other devices for roadway crack cleaning and repair have a number of disadvantages including, for example, one or more of the following:

1. They are excessively large and consequently difficult to maneuver, in many cases also requiring excessive lane width to be closed to regular traffic;
2. They are difficult to use in that the operator is required to manually steer the vehicle to accurately follow the crack, being particularly difficult when the driver's position does not afford a clear view of the crack and/or when lighting conditions are poor;
3. They have limited capability for following random cracks in that the cutters rotate on horizontal or generally horizontal axes;
4. They have limited effectiveness in that optional secondary operations that are indicated for portions of certain cracks (based on visual inspection, for example) are not permitted prior to filling; and
5. They are expensive to provide and operate in that they require heating and/or removal of excessive amounts of roadway material.

Thus there is a need for a roadway crack cleaning and repair system that overcomes the disadvantages of the prior art.

SUMMARY

The present invention meets this need by providing a roadway repair system including an appliance platform that is transversely driven relative to a vehicle in response to sensors thereby to automatically follow the crack as the vehicle is driven generally over the crack. In one aspect of the invention, the repair system includes a steerable vehicle for navigating the roadway; a platform assembly supported relative to the vehicle, at least a portion of the platform assembly being spaced directly above the roadway and being laterally movable relative to the vehicle; a sensor unit mounted on the movable portion of the platform and directed to the roadway below the platform assembly for detecting local variations in a sensed parameter during movement of the vehicle, a sensed continuous local deviation of the parameter being indicative of a roadway crack; a controller responsive to the sensor unit for generating an actuator drive signal that reflects a sensed lateral position of the crack relative to the sensor; an actuator for laterally positioning the platform in response to the actuator drive signal; and an appliance supported on the movable portion of the platform for performing a maintenance operation on the crack as the appliance follows the crack. As used herein, the terms laterally and longitudinally are orthogonal orientations relative to the vehicle being generally correspondingly aligned with the crack. In the case of cracks running generally longitudinally in the roadway, lateral and longitudinal have direct correspondence with a vehicle frame of reference. However, it is also contemplated than when cracks run generally across the roadway, laterally means forwardly and rearwardly with respect to the vehicle, there being a cross-slide carriage on the vehicle for supporting the platform. In that case, the vehicle is maneuvered generally perpendicular to the crack with the sensor unit positioned over the crack, and the cross-slide carriage is operated for traversing the crack, the appliance following the crack as indicated above.

The sensed parameter can be a spacing of the roadway below the platform assembly, a sensed continuously locally increased spacing being indicative of the crack. The sensor unit can include an array of sensor elements, each sensor element being directed to a respective portion of the roadway and producing a corresponding sensor signal. Preferably each sensor includes a source of radiation for projecting onto the roadway, the sensor signals being responsive to reflected portions of the radiation whereby the sensor unit is effective in the absence of ambient lighting. Preferably the sensor unit includes at least three of the sensor elements for enhanced crack detection, the elements being in a single laterally extending row. In cases wherein the width of the sensor elements is greater than a desired resolution of the sensor unit, the sensor unit preferably has the sensor elements in two rows, there being at least five of the sensor elements with an even number of the elements being in a first laterally extending row, an odd number of the elements being in a second laterally extending row that is longitudinally adjacent the first row, the odd number being one different from the even number, the sensors of the different rows being laterally interleaved for avoiding detection gaps between adjacent sensors. As used herein, the term longitudinally means orthogonally to the direction of lateral movement of the platform assembly, being generally in the direction of the crack. The first row can have four of the sensors, the second row having three of the sensors. Preferably the second row of sensor elements is displaced rearwardly of the first row for locating a central one of the sensors more closely to a following appliance. As used herein, rearwardly means perpendicular to the lateral movement of the platform assembly and opposite to the direction of movement of the sensor unit in tracking the crack.

The movable portion of the platform assembly can be supported by at least one glide shaft being connected to the vehicle, the actuator including a gear rack supported in parallel relation to the glide shaft, and a control motor supported on the platform assembly and having a pinion engaging the gear rack.

The appliance can be a router unit including a spindle assembly having a spindle shaft rotatably mounted in a spindle stator; a resilient mount for yieldingly supporting the spindle stator vertically oriented and laterally aligned with the sensor unit rearwardly thereof; means for rigidly mounting a routing cutter to the spindle shaft with the cutter extending below a nominal roadway height; and means for powering the spindle, whereby when the vehicle is maneuvered to generally follow the crack, the router unit is positioned on the movable portion of the platform to follow the crack with sufficient accuracy that the router cutter is guided by the crack, the resilient mount deflecting as required to limit side loading of the cutter, the cutter widening the crack by removing material from at least one side of the crack, unless the crack is wider than the cutter. The cutter will also function to break up dirt, rocks or weeds that may be present in the crack. The maneuvering of the vehicle to generally follow the crack is defined to include positioning the vehicle with the sensor unit approximately over a crack that runs generally crosswise to the path of the vehicle, and transporting the platform on a cross-slide to generally follow the crack, the sensor unit signaling the controller to laterally drive the platform in a manner more closely following the crack.

Preferably the system further includes a vacuum system having an inlet fixture supported on the platform behind the router unit for transporting loose material from the roadway, the transported material including material dislodged by the router unit. The inlet fixture can be a router vacuum inlet, the system further including an advance vacuum inlet supported on the platform ahead of the sensor unit for removing foreign material from the roadway to provide unobstructed indication of the roadway crack. Preferably the system further includes a scarifier appliance mounted on the platform ahead of the advance vacuum inlet for dislodging the foreign material. The scarifier appliance can include a laterally spaced array of scarifier wires and a laterally extending anchor bar for cantilevered support of the wires with root portions of the wires projecting from the anchor bar, a free end portion of each wire projecting downwardly and forwardly below the anchor bar, forward extremities of the wires being displaced rearwardly of the root portions.

Preferably the appliance includes a sealer outlet mounted to the movable portion of the platform assembly laterally aligned with the sensor unit rearwardly thereof for feeding a sealant medium into the crack. The system can further include a pressure roller mounted in depending relation to the platform rearwardly of the sealer outlet for compacting the sealant and the roadway proximate the crack; a sand outlet mounted to the platform rearwardly of the sealer outlet and ahead of the pressure roller for feeding a particulate medium onto the roadway ahead of the pressure roller; and a vacuum system having an inlet fixture supported on the platform behind the pressure roller for transporting loose material from the roadway, the transported material including portions of the particulate material not bondingly joined to the sealant and/or the roadway by the pressure roller.

The vehicle can be a first vehicle, the sensor unit being a first sensor unit, the controller being a first controller, and the actuator being a first actuator in a cleaning module wherein the appliance is a cleaning appliance selected from the group consisting of a scarifier, a router, and a vacuum system having a vacuum inlet for removing loose material from the roadway in and proximate the crack, the system further having a sealing module for filling the crack subsequent to operation of the cleaning module including a steerable second vehicle for navigating the roadway; a second platform assembly supported relative to the second vehicle, at least a portion of the second platform assembly being spaced directly above the roadway and being laterally movable relative to the second vehicle; a second sensor unit mounted on the movable portion of the second platform and directed to the roadway below the second platform assembly for detecting local variations in a sensed parameter during movement of the second vehicle, a sensed continuous local deviation of the parameter being indicative of the roadway crack; a second controller responsive to the second sensor unit for generating an actuator drive signal, the drive signal reflecting a sensed lateral position of the crack relative to the second sensor; a second actuator for laterally positioning the second platform in response to the actuator drive signal of the second controller; and a sealing appliance supported by the movable portion of the second platform for filling the crack as the sealing appliance follows the crack. The sealing appliance can include sealer outlet mounted to the movable portion of the platform carriage laterally aligned with the sensor unit rearwardly thereof for feeding a sealant medium into the crack.

In another aspect of the invention, a method for repairing roadway cracks includes:

(a) providing a crack cleaning module including a steerable first vehicle for navigating the roadway and having a first platform assembly laterally movable relative to the first vehicle in response to a first control signal, a first sensor unit being mounted on the first platform for detecting local variations in a sensed parameter during movement of the first vehicle, a sensed continuous local deviation of the parameter being indicative of the roadway crack; a first controller responsive to the first sensor unit for generating the first control signal, the control signal reflecting a sensed lateral position of the crack relative to the first sensor; a first actuator for laterally moving the first platform assembly in response to the first control signal; and a router unit mounted on the first platform behind the sensor unit and laterally aligned therewith;

(b) providing a crack sealing module including a steerable second vehicle for navigating the roadway and having a second platform assembly laterally movable relative to the second vehicle in response to a second control signal, a second sensor unit being mounted on the second platform for detecting local variations in a sensed parameter during movement of the second vehicle, a sensed continuous local deviation of the parameter being indicative of the roadway crack; a second controller responsive to the second sensor unit for generating the second control signal, the control signal reflecting a sensed lateral position of the crack relative to the second sensor; a second actuator for laterally moving the second platform assembly in response to the second control signal; and a sealer outlet mounted on the second platform behind the sensor unit and laterally aligned therewith;

(c) driving the first vehicle to generally follow the crack;

(d) activating the first controller for driving the first actuator thereby to track the crack;

(e) activating the router unit for machining opposite sides of the crack as the first platform is positioned for more closely following the crack in response to the first sensor unit;

(f) removing loosened material from the crack and from the roadway proximate the crack;

(g) driving the second vehicle to generally follow the crack after the machining by the router unit;

(h) activating the second controller for driving the second actuator thereby to track the crack; and (i) feeding a sealant medium through the sealer outlet as the second platform is positioned for more closely following the crack in response to the second sensor unit, at least a portion of the sealant medium flowing into the crack, thereby repairing the crack.

Preferably the method further includes:

(a) providing a scarifier appliance on the first platform ahead of the first sensor unit for loosening foreign material on the roadway proximate the crack; and (b) vacuuming loosened material from the roadway between the scarifier appliance and the first sensor unit.

Preferably the method further includes:

(a) providing a pressure roller on the second platform behind the sealer outlet for compacting the sealant medium and the roadway proximate the crack;

(b) feeding a particulate material onto the roadway between the sealer outlet and the pressure roller for preventing adhesion of sealant medium onto the pressure roller; and (c) compacting portions of the particulate material into the sealant within the crack by the pressure roller.

The crack can include a singular segment and a branched segment, the method preferably further including:

(a) activating a bias input of one of the controllers for selecting one branch of the branched segment to be followed by a corresponding one of the sensor units; and (b) biasing the control signal for driving the platform toward the one branch in response to the bias input when the one sensor unit detects a laterally spaced pair of continuous local deviations of the sensed parameter.

DRAWINGS

These and other features, aspects, and advantages of the present invention will become better understood with reference to the following description, appended claims, and accompanying drawings, where:

FIG. 2 is a side view of a crack cleaning module of the system of FIG. 1;

FIG. 3 is a perspective view showing platform carriage guide and drive assemblies of the cleaning module of FIG. 2;

FIG. 4 is a sectional detail view of a router unit of the cleaning module of FIG. 2;

FIG. 5 is a sectional view of the router unit of FIG. 4;

FIG. 6 is a side view of a crack sealing module of the system of FIG. 1;

FIG. 7 is a perspective view showing platform carriage guide and drive assemblies of the sealing module of FIG. 3;

FIGS. 8A–8G are plan diagram views of alternative crack sensor arrays of the modules of FIGS. 2 and 3;

DESCRIPTION

Figures 1, 9, 10:
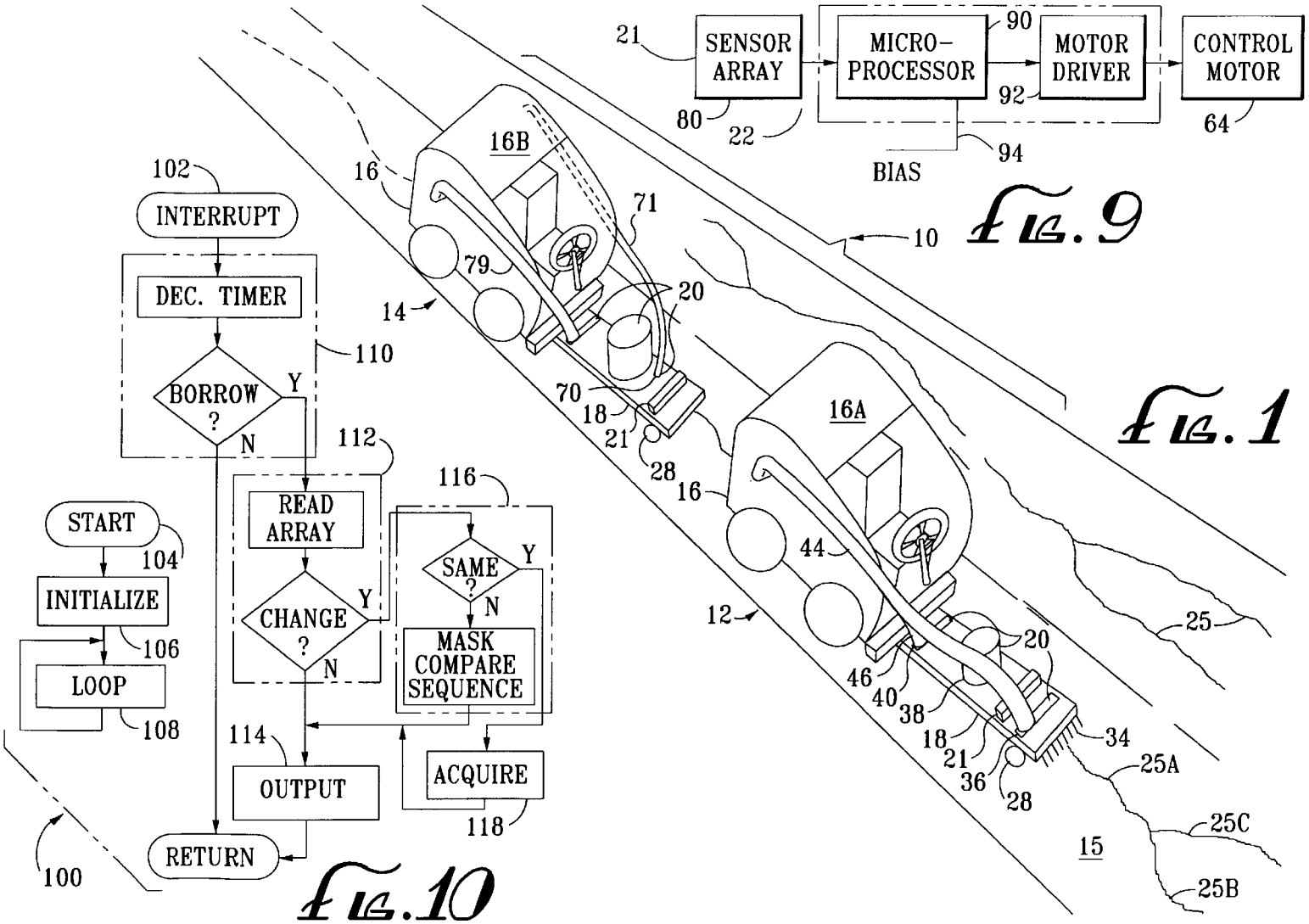
FIG. 1 is a perspective view of a roadway having cracks being repaired by a roadway crack repair system according to the present invention.
FIG. 9 is a block diagram of a position control system for the carriage drive assemblies of FIGS. 3 and 7.
FIG. 10 is a flow chart for a microprocessor control program for the modules of FIGS. 2 and 6.

The present invention is directed to a modular system for roadway crack cleaning and repair that is particularly effective in tracking and following typical roadway cracks. With reference to FIGS. 1–10 of the drawings, a crack repair system 10 includes cleaning module 12 and a sealing module 14 for use on a roadway 15, the cleaning and sealing modules 12 and 14 each including a maneuverable vehicle 16 (the vehicles being individually designated cleaner vehicle 16A and sealer vehicle 16B) that is equipped with a transversely movable carriage 18 having appliances 20 thereon as shown in FIG. 1. According to the present invention, each of the carriages 18 has a sensor unit 21 supported thereon for signaling irregularities of the roadway 15 to a controller 22 (See FIG. 9) that is carried by the vehicle 16, the platform carriage 18 also having an actuator 24 for positioning the carriage in response to the controller 22 as described below for following a roadway crack 25 that may have a variety of shapes. The platform carriage 18 is supported as described below by a frame 26 that extends forwardly from the vehicle 16. The carriage 18 supports the appliances 20 generally in longitudinal alignment with the sensor unit 21 so that each appliance is approximately centered over the crack 25 while the vehicle is maneuvered generally along the crack and the actuator 24 is maintaining the sensor unit 21 more or less accurately centered over the crack 25. In an exemplary and preferred implementation of the present invention, a pair of supportive swivel casters 28 are fastened under front corner extremities of the frame 26. A guide assembly 30 for the carriage 18 engages a circularly cylindrical glide shaft 32 that is transversely mounted to the frame 26, there being a parallel-spaced pair of the guide assemblies as shown in FIG. 3. Thus the carriage 18 is movable in parallel relation to the frame 26, as the vehicle 16 traverses the roadway 15, the front of the frame 26 being supported at a predetermined distance from the roadway by the casters 28, the rear of the frame 26 being supported by the vehicle 16.

As shown in FIG. 1, the platform carriage 18 of the cleaning module 12 supports appliances 20 including a scarifier 34, a scarifier vacuum inlet 36, a router unit 38, and a router vacuum inlet 40. The cleaning module 12 also has a vacuum unit 42 supported on the cleaner vehicle 16A (or on a trailer towed by the vehicle), respective flexible vacuum conduits 44 and 46 fluid-connecting the vacuum inlets 36 and 38 to the vacuum unit 42. The purpose of the scarifier 34 is to dislodge material that may have accumulated in the crack 25, the dislodged material being drawn into the scarifier vacuum inlet 36 and carried into the vacuum unit 42 for providing a clear view of the crack 25 to the sensor unit 21. Accordingly, the scarifier 34 is located at the front of the carriage 18, the scarifier vacuum inlet 40 being located between the scarifier 34 and the sensor unit 21. As shown in FIG. 3, the scarifier is formed by a transversely spaced plurality of scarifier wires 48, an upper end of each wire 48 being rigidly supported on the carriage 18 by a comb bar 49, a lower end of each wire projecting downwardly and forwardly to a location below and slightly behind the point of attachment to the comb bar 49 for allowing the lower ends of the wires 48 to deflect upwardly and rearwardly when encountering rigidly fixed irregularities of the roadway 15. The scarifier 34 is not required to completely clean the crack 25, but rather to remove material that would otherwise obscure the location of the crack from the sensor unit 21.

The router unit 38 is located immediately aft of the sensor unit 21 for minimizing the effects of skewed orientation of the crack 25 relative to the platform carriage 18, the router vacuum inlet 40 being located behind the router unit 38 and ahead of the guide assembly 30. Also, a router shield 39 is interposed between the sensor unit 21 and the router unit as shown in FIG. 2 for blocking forward movement of routed material that might otherwise interfere with operation of the sensor unit 21. As shown in FIGS. 4 and 5, the router unit 38 includes a spindle assembly 50 mounted on a base plate 51 of the platform carriage 18, the spindle assembly 50 having a spindle shaft 52 rotatably supported by antifriction bearings 53 in a stator structure 54. In the drawings, the stator structure 54 is shown as a pair of circular plates, the bearings 53 having a flanged configuration, and the spindle shaft 52 being stepped for defining a spacing between the plates of the stator structure 54. The shaft 52 rotates on a spindle axis 55, having conventional means for rigidly holding a router cutter 56 that is used to more thoroughly clean the crack 25 in preparation for sealing by the sealing module 14. Typically, the router cutter 56 has a diameter of approximately 0.5 inch.

In order to allow for variations in tracking of the crack 25, and for some skew in the orientation of the crack relative to the platform carriage 18, the spindle assembly 50 is resiliently supported on the carriage 18 by a flexible spindle support 57 that allows the spindle axis 55 to be displaced laterally and/or angularly as indicated at 55' in FIG. 4. As best shown in FIG. 5, the spindle support 57 includes a circularly spaced plurality of support springs 58, opposite ends of each spring 58 being fastened by suitable spring anchor fasteners 59 to the stator structure 54 and the base plate 51, the plate 51 being rigidly connected to the platform carriage 18 by any suitable means. Thus the router cutter 56 can deflect laterally, and the spindle axis 55 can deflect angularly from being vertically oriented, in response to side forces encountered by the spindle assembly 50 as the cutter 56 rotates in the crack 25. The spindle assembly 50 may be rotatably powered using any suitable means, exemplary means being a belt drive 60 having a spindle sheave 62 that is mounted on the spindle shaft 52, the belt drive 60 being powered from a suitable driven shaft (not shown) of the cleaner vehicle 16A.

As best shown in FIGS. 3 and 7, an exemplary configuration of the actuator 24 includes a control motor 64 having an output pinion 66 that engages a gear rack 68, the rack 68 being mounted to the frame 26 near one of the glide shafts 32 and parallel thereto by a pair of brackets 69. (Only one of the guide assemblies 30 and glide shaft 32 is shown in FIG. 7.) Alternatively, the motor 64 and pinion 66 can be mounted to the frame 26, the rack 68 being mounted to the carriage 18 for simplified wiring of the motor 64; however, it is preferred to have the rack 68 stationary as described above for permitting extended lateral travel of the carriage 18 without the rack 68 having to project beyond the width of the vehicle 16.

As shown in FIG. 1, the platform carriage 18 of the sealing module 14 supports at least one appliance 20 which can be a crack sealer outlet 70 that is fluid connected by a sealer conduit 71 to a sealer feeder 72 being carried by the sealer vehicle 16B. The sealer outlet 70 is located closely behind the sensor unit 21, being longitudinally aligned therewith for following the crack 25 and filling same with a suitable sealant medium 73 when the controller 22 and the actuator 24 drives the platform carriage 18 for tracking the crack 25 as described above and in more detail below. The sealant medium can be a material that adheres to both sides of the crack 25 and, particularly in cases of wider cracks, the medium can contain a filler such as sand.

Optionally, the sealing module 14 is provided with a pressure roller 74 for leveling the roadway surface immediately adjacent to the crack 25. The roller 74 is sufficiently wide to contact the roadway 15 on both sides of the crack 25, and being sufficiently large in diameter for making rolling contact with the irregular matter as may be present following the cleaning and filling of the crack as described above, a suitable roller diameter being from approximately 5 inches to approximately 24 inches. Also, the roller 74 is effective for compacting the sealant medium being applied to the crack 25 and pressing the medium down into the crack. When the pressure roller 74 is employed, a quantity of sand 75 is preferably applied in the vicinity of the crack 25 upstream of the roller for avoiding adhesion and collection of the sealant medium on the roller 76. Accordingly, a sand hopper 76 is mounted on the platform carriage 18 and having a sand outlet 77 between the sealer outlet 70 and the roller 76 for distributing the sand in a sufficiently wide pattern to encompass the width of the pressure roller or at least to cover all of the applied sealant medium 73. A portion of the sand 75 is expected to become imbedded in the sealant, advantageously forming a composite having greater structural integrity than the sealant alone. Further, a sand vacuum inlet 78 is preferably located behind the pressure roller 74 for collecting sand 75 that does not adhere to the sealant medium 73, the vacuum inlet 78 being fluid connected by a sand vacuum conduit 79 to a counterpart of the vacuum unit 42 being transported by the sealer vehicle 16B.

With particular reference to FIGS. 8A–8G, exemplary configurations of the sensor unit 21 include a transversely oriented sensor array 80 of sensors 82, the sensors 82 individually signaling variations of the roadway 15 to the controller 22 by suitable means such as by parallel or multiplexed outputs. The sensors 82 can be distance-sensitive proximity sensors for signaling as cracks local depressions in the roadway 15, such sensors being commercially available as the Cutler-Hammer Perfect Prox diffuse reflective sensor No. 13104A6517 from Kaman Industrial Technologies Corp. of Rancho Cucamonga, Calif. The above-identified sensor is configured for a 2-inch range, other such sensors being configured for 4-inch and 6-inch ranges, the version having the 2-inch range being preferred based on its particularly sharp cut-off at the threshold range. These sensors each have a width of approximately 0.47 inch, with an active width of approximately 0.25 inch. It is contemplated that the sensors 82 will be mounted with the cut-off range being slightly (by approximately 0.25 inch) below the nominal level of the roadway 15, irregularities extending more than approximately 0.5 inch below the nominal roadway level being reliably signaled to the controller 22.

In FIG. 8A, there are four of the sensors 82, five of the sensors being shown in FIG. 8B, and seven of the sensors 82 being shown in FIG. 8C, the sensors 82 being arranged in a single row in each case and having a center-to-center spacing S. With the above-identified sensors 82 closely spaced in a single row, coverage is not continuous in that the active width, identified as $\omega$ in FIG. 8A, is less than the spacing S. Consequently, a narrow crack that is centered between adjacent sensors 82 may go undetected, the controller 22 being unable to distinguish conditions of tracking from no tracking except by inference from past history. Thus it is preferred to have an odd number of the sensors 82 as shown in FIGS. 8B and 8C so that perfect tracking would produce an active output from the center sensor as long as the crack 25 is sufficiently wide to be detected. Also, conditions wherein the crack extends to or beyond an outside one of the sensors 82 are less precisely distinguished because the width of the crack is variable. Thus it is preferred that the array 80 be sufficiently wide to encompass commonly encountered crack widths; however, it is also preferred to have the sensors closely spaced for avoiding cases of narrow cracks being undetected by being located between the active widths of adjacent sensors. Thus it is further preferred to have a relatively large number of sensors that are closely spaced.

In each of FIGS. 8D–8G, there are odd numbers of the sensors 82 in two staggered and closely spaced rows, there being five of the sensors 82 in FIGS. 8D and 8E, and seven of the sensors in FIGS. 8F and 8G. In each case one of the rows has an even number of the sensors 82, there being an odd number that is one different than the even number in the other row. Also, the row having the odd number of sensors is located forwardly of the other row in FIGS. 8D and 8G, the relative positions being reversed in FIGS. 8E and 8F, the forward movement of the sensor array 80 being indicated by arrows in each of FIGS. 8D–8G. It is preferred that the row having the odd number of sensors 82 be to the rear, in closer proximity to the following appliance 20 (the router unit 38 of the cleaner module 12 and the sealer outlet 70 of the sealer module 14) for enhanced tracking accuracy when the sensor array 80 signals perfect tracking in the cases of the crack 25 being skewed. Accordingly, the configuration of FIG. 8F is most preferred among those depicted in FIGS. 8D–8G, the configurations of FIGS. 8B and 8C being meritorious for providing wider coverage, the configurations of FIGS. 8B and 8C also advantageously having an odd number of the sensors 82 but the configuration of FIG. 8B having narrower coverage than that of FIG. 8C. It will be understood that arrangements of greater numbers of sensors 82 are possible, such as nine sensors in two rows, although with commonly practiced microprocessor technology implementation of the controller 22 is facilitated by having not more than eight of the sensors 82. It is contemplated that suitable sufficiently narrow sensor elements will become available such that the spacing S can match the sensed width $\omega$, in which case the single-row configuration of FIG. 8C would be the most preferred among those depicted.

As shown in FIG. 9, the controller 22 includes a microprocessor 90 and a driver 92, an input interface of the microprocessor receiving signals from the sensor array 80 of the sensor unit 21. The driver 92 has inputs connected to an output interface of the microprocessor 90, outputs of the driver being connected to the control motor 64 for lateral movement of the platform carriage as described above. It will be understood that interface connections of the microprocessor may be defined as input or output by program instructions that are executed during a software or firmware initialization sequence. Other connections to the microprocessor include a bias input 94 and other appropriate operator controls (not shown). The bias input 94 is used by the operator for urging the controller 22 to drive the platform 18 selectively toward one branch component of the crack 25 when the sensor unit 21 passes from a singular crack segment as indicated at 25A in FIG. 1 to a branched segment as indicated at 25B and 25C in FIG. 1. The bias input 94 can be implemented by a simple SPST toggle switch that signals the microprocessor 90 on a single line. A preferred alternative is to use a SPDT switch having a center-off position and separately signaling right- and left-bias inputs to the microprocessor. In that case, there can also be momentary push-button switches or equivalent means for temporarily augmenting or overriding the setting of the SPDT switch. Operation of the controller 22 in response to the bias input 94 is further described below.

As shown in FIG. 10, an exemplary control program 100 for the microprocessor 90 is configured for analyzing relevant combinations of signals from the sensor array 80 in order to generate suitable drive signals for the control motor 64. The program 100 includes an interrupt routine 102 that is periodically initiated by a timer module of the microprocessor 90, and a main routine 104. The Main routine 104 includes an initialization sequence 106 wherein variables are reset and the clock timer is activated, followed by an endless loop 108 that continues until an interrupt is encountered. The interrupt routine 102 includes a clock service sequence 110 that decrements a timer variable and returns directly to the main routine 102, except that when the timer variable underflows, a sensor subroutine 112 is executed for reading and analyzing the sensor array 80, followed by an output routine 114 for correspondingly signaling the driver 92 to move the platform carriage 18 to move a designated distance for tracking the crack 25.

In the sensor subroutine 112, the sensor array 80 is read and tested for any change relative to a last previous reading. When there is no change, the subroutine is exited immediately, control being transferred to the output routine 114 for maintaining a previously signaled activation of the driver 92. It will be understood that although various implementations of the control motor 64 are contemplated, one such implementation is a stepper motor wherein a plurality of motor phase windings are driven in a progressive sequence to advance the motor, the motor holding its position when the sequence is halted. When the designated distance is more than a single step, the output routine 114 can produce steps following the first one in subsequent executions of the output routine. Also, some known stepper motor implementations involve dynamic damping of motor oscillations, which can also be implemented in repeated executions of the output routine. In the present invention, the control motor 64 can be implemented as a stepper motor that is responsive to both "half-step" and "full-step" activations in a manner known to those having skill in the art. In this case, the output routine 114 advances an output phase of the driver 92 by the indicated half-step or full-step distance, merely holding that phase in subsequent entries of the output routine 114 unless the sensor subroutine 112 calls for a new position of the platform carriage 18. In a preferred variation that is potentially more accurate, the control motor is driven at a rate proportional to the positional error, known in the control system art as a type-1 servo.

When a change of the signals from the sensor array 80 is encountered in the sensor subroutine 112, program control advances to an analysis sequence 116 that proceeds by a process of pattern matching to derive an "error signal" to be used by the output routine 114. In the exemplary case of the control motor 64 being a stepper motor having "half-step" and "full-step" responses, the error signal may have only five possible values, namely −1, −½, 0, ½, and +1. Also, with the array 80 having seven of the (digital) sensors 82, 128 output states of the sensors are possible. While a pure table look-up using a memory of 128 addresses of 3-bits each is possible, an exemplary and preferred implementation of the analysis sequence 116 uses a decision tree having series of masks and comparisons of sensor outputs to generate the error signal. Table 1 lists the possible output states of the sensors 82 grouped by cases considered to have like significance, with indications of the resulting error signal.

The table lists an "address" being the decimal equivalent of the sensor output states; the states of the individual sensors 82 (from the leftmost, L3, L2, L1, center, R1, R2, progressively to the rightmost, R3); "move" (a preliminary form of the error signal); "mask"; and "match". In cases 1 and 2, all seven outputs are the same, and control is transferred to an acquire sequence 118 that is described below, it being assumed that the crack 25 is not in view, or the height of the sensor array 21 is improperly adjusted. (Another possibility is that the crack 25 extends beyond opposite sides of the array 80.)

In cases 3–17, the sensor output states are interpreted as detecting a single crack 25, the crack being centered under the array 80 in cases 3, 6, and 11, with the resulting error signal being zero. Cases 4 and 9 produce an error signal of −½, cases 7, 12, 14 and 15 produce an error signal of −1, while cases 5 and 10 produce an error signal of +½ and cases 8, 13, 16, and 17 produce an error signal of +1. In an exemplary case, case 4, the center and L1 sensors signal a depression, the sensors L2 and R1 on either side signaling no depression. Accordingly, the crack 25 is deemed to be centered halfway between the center and L1 sensors, the sensors L3, R2 and R3 being ignored. Thus the analysis sequence includes instructions for each of the cases, masking off the ignored bits of the address in case 4 by the hexadecimal value of 3C, which has zeroes in the ignored bit locations. (This masking portion of the analysis is common to cases 4, 7, 17, and 20.) Following the masking, the result is compared with a match quantity of 18 hexadecimal of case 4, a match confirming that case and the error signal being set to −½ with control being returned to the calling portion of the interrupt routine 108, at the output routine 114. Absent a match, other possible cases are similarly tested, a positive result being eventually assured in that the table encompasses all possible output combinations of the sensor array 80.

In cases 18–24, the sensor output states are deemed to indicate the presence of two cracks in the roadway 15. In one common possibility, a single crack branches to form separate cracks, it being necessary to elect which of the cracks to follow. Consequently, an operator of the vehicle 16 can use the bias input 94 for making the election, the error signal being set according to the bias input 94. Alternatively, the analysis sequence 116 for the cases 18–24 can have separate tabulations of the error signal for each state of the bias input 94 (two in the case of the SPST switch described above, three in the case of the SPDT switch). Also, the analysis sequence 116 can be responsive to the pair of momentary push-button switches described above in each of the cases 3–24 for producing a manual offset in the controlled position of the platform carriage 18.

In the acquire sequence 118, the error signal can be set according to the bias input 94 as in the cases 18–24, the operator manipulating the bias input for moving the sensor unit 21 over a visually observed crack 25 in the roadway 15. Alternatively, the acquire sequence 118 can produce repetitively alternating error signals in a predetermined pattern for producing a scanning lateral movement of the platform carriage 18. In either alternative, the acquire sequence 118 is automatically bypassed in succeeding cycles of the interrupt routine 102 in response to the analysis sequence 116 processing sensor output states other than cases 1 and 2.

Although the present invention has been described in considerable detail with reference to certain preferred versions thereof, other versions are possible. For example, the sensor elements 82 can provide a multiple bit or analog indication of the sensed variable instead of a single-bit digital signal, for enhanced effectiveness in tracking the crack 25. The scarifier 34 can be configured as a rotating wire brush, ground-contacting portions of the brush preferably moving in a direction for sweeping debris away from the path of the sensor unit 21 such that use of the vacuum inlet 36 is not required. Also, the router unit 38 can be supported on an elevator mechanism for adjusting the depth of routing, and for raising the router cutter 56 to clear the roadway 15 when the router unit is not being used. Further, the vacuum unit, the sealer feeder, and the sand hopper can each be optionally carried on the vehicle 16, the frame 26, or on the platform carriage 18. Moreover, when the roadway 15 has the cracks 15 running generally crosswise, the platform carriage 18 can be oriented orthogonally to the vehicle 16 relative to the orientation shown in the drawings, being supported on a cross-slide carriage. The vehicle is driven along the roadway generally perpendicular to the crack and stopped or nearly stopped with the sensor unit positioned over the crack, and the cross-slide carriage is operated for traversing the crack, the controller 22 operating to cause the sensor unit 21 to track the crack. Although it is preferred to have separate vehicles for the cleaning and sealing modules 12 and 14, it is also contemplated that the complete system can be provided on a single vehicle. Therefore, the spirit and scope of the appended claims should not necessarily be limited to the description of the preferred versions contained herein.

What is claimed is:

1. A roadway crack repair system comprising:

(a) a steerable vehicle for navigating the roadway;

(b) a platform assembly supported relative to the vehicle, at least a portion of the platform assembly being spaced directly above the roadway and being laterally movable relative to the vehicle;

(c) a sensor unit mounted on the movable portion of the platform and directed to the roadway below the platform assembly for detecting local variations in a sensed parameter during movement of the vehicle, a sensed continuous local deviation of the parameter being indicative of a roadway crack;

(d) a controller responsive to the sensor unit for generating an actuator drive signal, the drive signal reflecting a sensed lateral position of the crack relative to the sensor;

(e) an actuator for laterally positioning the platform in response to the actuator drive signal;

(f) an appliance supported by the movable portion of the platform for performing a maintenance operation on the crack as the appliance follows the crack.

2. The crack repair system of claim 1, wherein the sensed parameter is a spacing of the roadway below the platform assembly, a sensed continuously locally increased spacing being indicative of the crack.

3. The crack repair system of claim 1, wherein the sensor unit comprises an array of sensor elements, each sensor element being directed to a respective portion of the roadway and producing a corresponding sensor signal.

4. The crack repair system of claim 3, each sensor element includes a source of radiation, the sensor signals being responsive to reflected components of the radiation.

5. The crack repair system of claim 3, wherein the sensor unit comprises at least three of the sensor elements, the elements being in a single laterally extending row.

6. The crack repair system of claim 3, wherein the sensor unit comprises at least five of the sensor elements, an even number of the elements being in a first laterally extending row, an odd number of the elements being in a second laterally extending row that is longitudinally spaced from the first row, the odd number being one different from the even number, the sensors of the different rows being laterally interleaved.

7. The crack repair system of claim 6, wherein the first row has four of the sensors, the second row having three of the sensors.

8. The crack repair system of claim 6, wherein the second row of sensor elements is displaced rearwardly of the first row.

9. The crack repair system of claim 1, wherein the movable portion of the platform assembly is supported by at least one glide shaft being connected to the vehicle, and wherein the actuator comprises a gear rack supported in fixed parallel relation to the glide shaft, and a control motor supported on the movable portion of the platform assembly and having a pinion engaging the gear rack for moving the platform assembly.

10. The crack repair system of claim 1, wherein the appliance is a router unit comprising:

(a) a spindle assembly having a spindle shaft rotatably mounted in a spindle stator;

(b) a resilient mount for yieldingly supporting the spindle stator vertically oriented and laterally aligned with the sensor unit rearwardly thereof;

(c) means for rigidly mounting a routing cutter to the spindle shaft with the cutter extending below a nominal roadway height; and (d) means for powering the spindle, whereby when the vehicle is maneuvered to generally follow the crack, the router unit is positioned on the movable portion of the platform assembly to follow the crack with sufficient accuracy that the router cutter is guided by the crack, the resilient mount deflecting as required to limit side loading of the cutter, the cutter widening the crack by removing material from at least one side of the crack.

11. The crack repair system of claim 9, further comprising a vacuum system having an inlet fixture supported on the platform behind the router unit for transporting loose material from the roadway, the transported material including material dislodged by the router unit.

12. The crack repair system of claim 9, wherein the inlet fixture is a router vacuum inlet, the system further comprising an advance vacuum inlet supported on the platform ahead of the sensor unit for removing foreign material from the roadway to provide unobstructed indication of the roadway crack.

13. The crack repair system of claim 11, further comprising a scarifier appliance mounted on the platform ahead of the advance vacuum inlet for dislodging the foreign material.

14. The crack repair system of claim 11, wherein the scarifier appliance comprises a laterally spaced array of scarifier wires and a laterally extending anchor bar for cantilevered support of the wires with root portions of the wires projecting from the anchor bar, a free end portion of each wire projecting downwardly and forwardly below the anchor bar, forward extremities of the wires being displaced rearwardly of the root portions.

15. The crack repair system of claim 1, wherein the appliance is a sealer outlet mounted to the movable portion of the platform assembly laterally aligned with the sensor unit rearwardly thereof for feeding a sealant medium into the crack.

16. The crack repair system of claim 14, further comprising:

(a) a pressure roller mounted in depending relation to the platform rearwardly of the sealer outlet for compacting the sealant and the roadway proximate the crack;

(b) a sand outlet mounted to the platform rearwardly of the sealer outlet and ahead of the pressure roller for feeding a particulate medium onto the roadway ahead of the pressure roller; and (c) a vacuum system having an inlet fixture supported on the platform behind the pressure roller for transporting loose material from the roadway, the transported material including portions of the particulate material not bondingly joined to the sealant and/or the roadway by the pressure roller.

17. The crack repair system of claim 1, wherein the vehicle is a first vehicle, the sensor unit is a first sensor unit, the controller is a first controller, and the actuator is a first actuator in a cleaning module wherein the appliance is a cleaning appliance selected from the group consisting of a scarifier, a router, and a vacuum system having a vacuum inlet for removing loose material from the roadway in and proximate the crack, the system further comprising a sealing module for filling the crack subsequent to operation of the cleaning module, the sealing module including:

(a) a steerable second vehicle for navigating the roadway;

(b) a second platform assembly supported relative to the second vehicle, at least a portion of the second platform assembly being spaced directly above the roadway and being laterally movable relative to the second vehicle;

(c) a second sensor unit mounted on the movable portion of the second platform and directed to the roadway below the second platform assembly for detecting local variations in a sensed parameter during movement of the second vehicle, a sensed continuous local deviation of the parameter being indicative of the roadway crack;

(d) a second controller responsive to the second sensor unit for generating an actuator drive signal, the drive signal reflecting a sensed lateral position of the crack relative to the second sensor;

(e) a second actuator for laterally positioning the second platform in response to the actuator drive signal of the second controller;

(f) a sealing appliance supported by the movable portion of the second platform for filling the crack as the sealing appliance follows the crack.

18. The crack repair system of claim 16, wherein the sealing appliance includes a sealer outlet mounted to the movable portion of the platform assembly laterally aligned with the sensor unit and rearwardly thereof for feeding a sealant medium into the crack.

19. A method for repairing roadway cracks, comprising:

(a) providing a crack cleaning module comprising:

(i) a steerable first vehicle for navigating the roadway and having a first platform assembly laterally movable relative to the first vehicle in response to a first control signal, a first sensor unit being mounted on the first platform assembly for detecting local variations in a sensed parameter during movement of the first vehicle, a sensed continuous local deviation of the parameter being indicative of the roadway crack;

(ii) a first controller responsive to the first sensor unit for generating the first control signal, the control signal reflecting a sensed lateral position of the crack relative to the first sensor;

(iii) a first actuator for laterally moving the first platform assembly in response to the first control signal; and (iv) a router unit mounted on the first platform assembly behind the sensor unit and laterally aligned therewith;

(b) providing a crack sealing module comprising:

(i) a steerable second vehicle for navigating the roadway and having a second platform assembly laterally movable relative to the second vehicle in response to a second control signal, a second sensor unit being mounted on the second platform assembly for detecting local variations in a sensed parameter during movement of the second vehicle, a sensed continuous local deviation of the parameter being indicative of the roadway crack;

(ii) a second controller responsive to the second sensor unit for generating the second control signal, the control signal reflecting a sensed lateral position of the crack relative to the second sensor;

(iii) a second actuator for laterally moving the second platform assembly in response to the second control signal; and (iv) a sealer outlet mounted on the second platform assembly behind the sensor unit and laterally aligned therewith;

(c) driving the first vehicle to generally follow the crack;

(d) activating the first controller for driving the first actuator thereby to track the crack;

(e) activating the router unit for machining opposite sides of the crack as the first platform is positioned for more closely following the crack in response to the first sensor unit;

(f) removing loosened material from the crack and from the roadway proximate the crack;

(g) driving the second vehicle to generally follow the crack after the machining thereof by the router unit;

(h) activating the second controller for driving the second actuator thereby to track the crack; and (i) feeding a sealant medium through the sealer outlet as the second platform is positioned for more closely following the crack in response to the second sensor unit, the at least a portion of the sealant medium flowing into the crack, thereby repairing the crack.

20. The method of claim 18, further comprising:

(a) providing a scarifier appliance on the first platform ahead of the first sensor unit for loosening foreign material on the roadway proximate the crack; and (b) vacuuming loosened material from the roadway between the scarifier appliance and the first sensor unit.

21. The method of claim 18, further comprising:

(a) providing a pressure roller on the second platform behind the sealer outlet for compacting the sealant medium and the roadway proximate the crack;

(b) feeding a particulate material onto the roadway between the sealer outlet and the pressure roller for preventing adhesion of sealant medium onto the pressure roller; and (c) compacting portions of the particulate material into the sealant within the crack by the pressure roller.

22. The method of claim 18, wherein the crack includes a singular segment and a branched segment, the method further comprising:

(a) activating a bias input of one of the controllers for selecting one branch of the branched segment to be followed by a corresponding one of the sensor units; and (b) biasing the control signal for driving the platform toward the one branch in response to the bias input when the one sensor unit detects a laterally spaced pair of continuous local deviations of the sensed parameter.

* * * * *